US008162318B1

(12) United States Patent
Peterson et al.

(10) Patent No.: US 8,162,318 B1
(45) Date of Patent: Apr. 24, 2012

(54) ARTICLE TOSSING GAME ASSEMBLY

(76) Inventors: Kevin W. Peterson, Salem, SD (US); Charles Layne, Salem, SD (US)

( * ) Notice: Subject to any disclaimer, the term of this patent is extended or adjusted under 35 U.S.C. 154(b) by 138 days.

(21) Appl. No.: 12/855,852

(22) Filed: Aug. 13, 2010

(51) Int. Cl.
*A63B 63/00* (2006.01)

(52) U.S. Cl. ..... 273/402; 273/343

(58) Field of Classification Search ..... 273/398–402, 273/343
See application file for complete search history.

(56) References Cited

U.S. PATENT DOCUMENTS

| | | | | | |
|---|---|---|---|---|---|
| 285,396 | A | * | 9/1883 | De Windt | 273/382 |
| 2,932,516 | A | * | 4/1960 | Penner | 273/402 |
| 3,576,987 | A | | 5/1971 | Voight et al. | |
| 4,695,055 | A | | 9/1987 | Newcomb et al. | |
| 4,709,929 | A | * | 12/1987 | Mills et al. | 273/402 |
| 4,762,319 | A | * | 8/1988 | Krumholz | 473/416 |
| 4,936,590 | A | | 6/1990 | Palmer | |
| 4,961,586 | A | * | 10/1990 | Conville | 273/402 |
| 4,984,787 | A | | 1/1991 | Nesbit et al. | |
| 5,909,877 | A | | 6/1999 | Bour | |
| 6,244,598 | B1 | | 6/2001 | Conville | |
| D478,939 | S | | 8/2003 | McReynolds | |
| 6,889,982 | B1 | * | 5/2005 | Gove | 273/343 |
| 7,210,685 | B2 | * | 5/2007 | Cheng | 273/348.4 |
| 7,854,528 | B2 | * | 12/2010 | Segretto et al. | 362/191 |
| 7,909,329 | B1 | * | 3/2011 | Martinson | 273/330 |
| 2002/0125644 | A1 | * | 9/2002 | Knudson | 273/398 |
| 2003/0098545 | A1 | * | 5/2003 | Webb | 273/343 |
| 2004/0108658 | A1 | * | 6/2004 | Bartel | 273/398 |
| 2005/0051968 | A1 | * | 3/2005 | Froesel | 273/336 |
| 2006/0125186 | A1 | | 6/2006 | Digges, III et al. | |
| 2007/0052178 | A1 | | 3/2007 | Cottrell | |
| 2007/0184920 | A1 | * | 8/2007 | Mah et al. | 473/446 |
| 2008/0042360 | A1 | | 2/2008 | Veikley | |
| 2008/0157476 | A1 | * | 7/2008 | Striebel et al. | 273/402 |
| 2009/0115136 | A1 | * | 5/2009 | Voden | 273/336 |
| 2010/0164175 | A1 | * | 7/2010 | Buchanan | 273/402 |
| 2011/0215528 | A1 | * | 9/2011 | Conville et al. | 273/402 |

* cited by examiner

*Primary Examiner* — Mark Graham

(57) ABSTRACT

An article tossing game assembly includes a frame with a first elongated member and a second elongated member. A plurality of bracing members is attached to and extends between the first and second elongated members. A mount is attached to one of the bracing members. A light emitting apparatus is attached to the mount. A panel is positioned on an upper side of the frame and covers the frame. The panel has a top side and a bottom side and has an aperture therein extending into the top side and outwardly of the bottom side. The aperture is positioned adjacent to the light emitter. The panel is comprised of a translucent material. The light emitter is visible through the panel to direct a person where to aim when attempting to throw articles through the aperture.

11 Claims, 5 Drawing Sheets

ARTICLE TOSSING GAME ASSEMBLY

BACKGROUND OF THE DISCLOSURE

Field of the Disclosure

The disclosure relates to thrown article receiving devices and more particularly pertains to a new thrown article receiving device for receiving thrown articles during a game.

SUMMARY OF THE DISCLOSURE

An embodiment of the disclosure meets the needs presented above by generally comprising a frame that includes a first elongated member and a second elongated member that are spaced from each other and are orientated parallel with respect to each other. A plurality of bracing members is attached to and extends between the first and second elongated members. Each of the first and second elongated members has a first end and a second end. A mount is attached to one of the bracing members. A light emitting apparatus is attached to the mount. A panel is positioned on an upper side of the frame and covers the frame. The panel has a top side and a bottom side and has an aperture therein extending into the top side and outwardly of the bottom side. The aperture is positioned adjacent to the light emitter. The panel is comprised of a translucent material. The light emitter is visible through the panel to direct a person where to aim when attempting to throw articles through the aperture.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
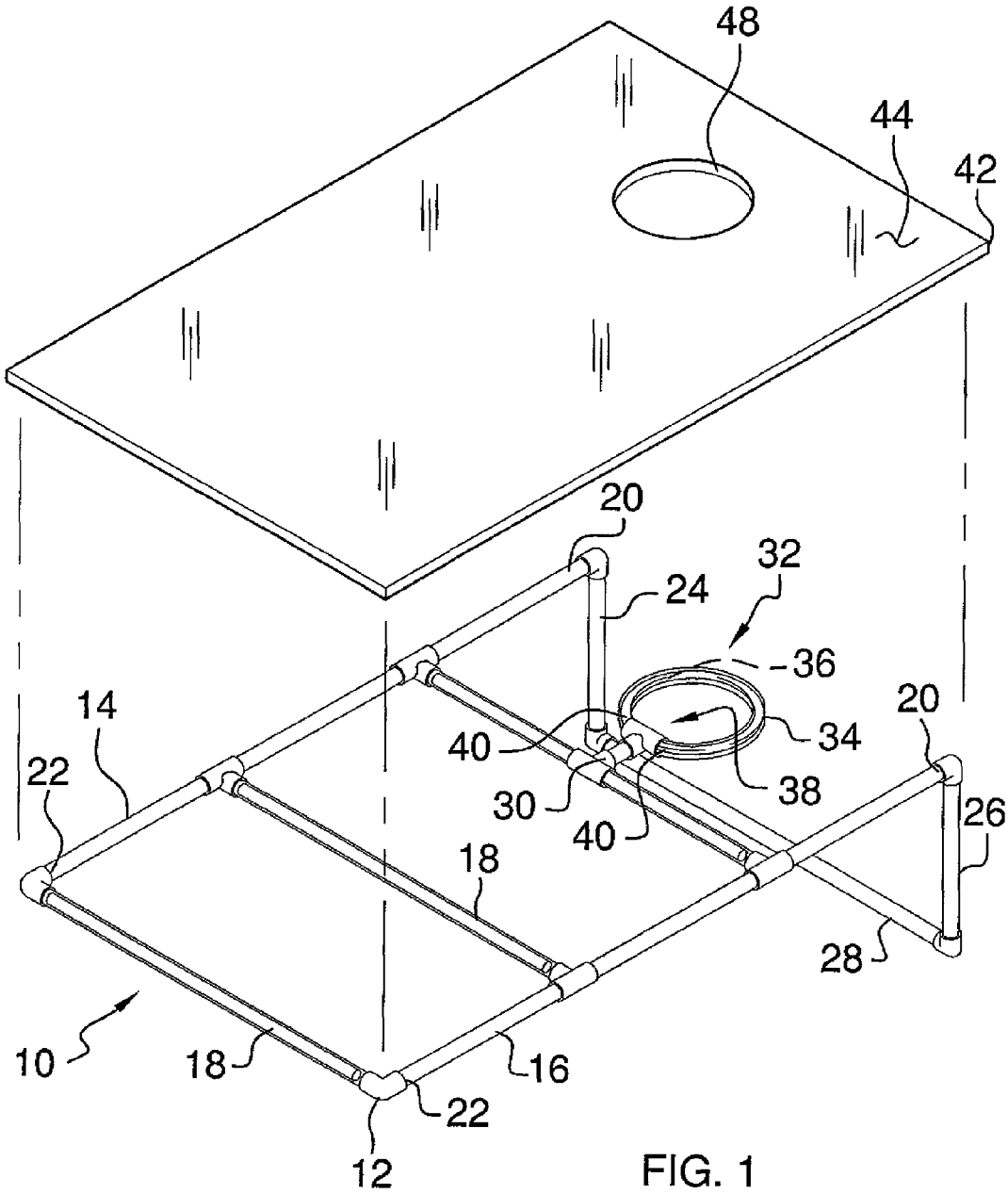
FIG. 1 is a top perspective view of a article tossing game assembly according to an embodiment of the disclosure.
Figure 2:
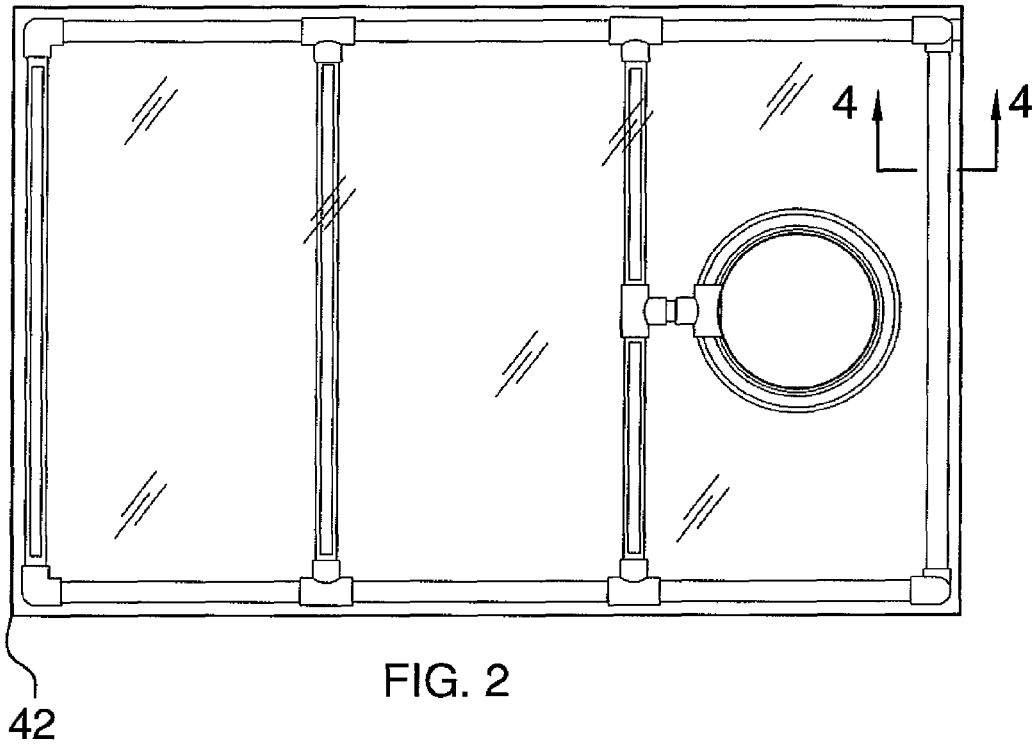
FIG. 2 is a top view of an embodiment of the disclosure.
Figure 3:
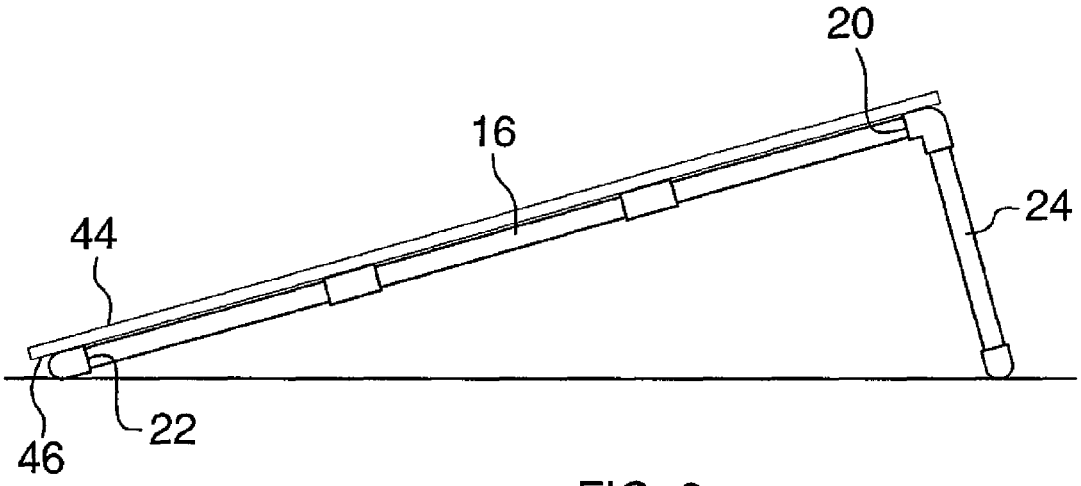
FIG. 3 is a side view of an embodiment of the disclosure.
Figure 4:
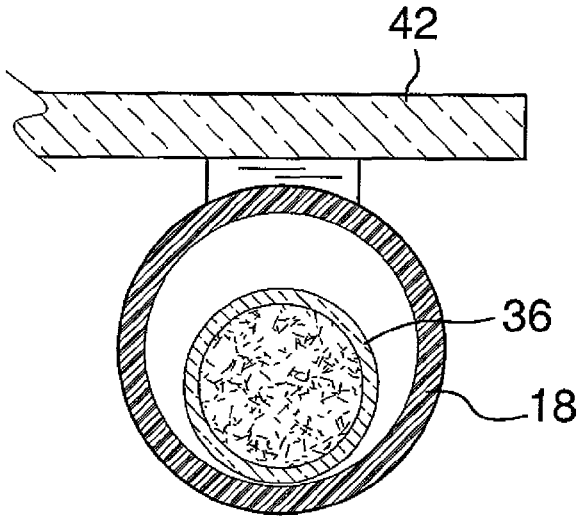
FIG. 4 is a cross-sectional view of an embodiment of the disclosure taken along line 4-4 of FIG. 2.

With reference now to the drawings, and in particular to FIGS. 1 through 7 thereof, a new thrown article receiving device embodying the principles and concepts of an embodiment of the disclosure and generally designated by the reference numeral 10 will be described.

As best illustrated in FIGS. 1 through 7, the article tossing game assembly 10 generally comprises a frame 12 that includes a first elongated member 14 and a second elongated member 16 that are spaced from each other and are orientated parallel with respect to each other. A plurality of bracing members 18 is attached to and extends between the first 14 and second 16 elongated members. Each of the first 14 and second 16 elongated members has a first end 20 and a second end 22. A first leg 24 is attached to and extends downwardly from the first end 20 of the first elongated member 14 and a second leg 26 is attached to and extends downwardly from the first end 20 of the second elongated member 16. The legs support the frame 12 in an angular relationship with respect to a ground surface and are angled downwardly from the first ends 20 to the second ends 22 of the elongated members 14, 16. A brace 28 is attached to and extends between distal ends of legs with respect to the first ends 20.

A mount 30 is attached to one of the bracing members 18 and is positioned nearer the first ends 20 than the second ends 22 and is also positioned approximately an equal distance from the first 14 and second 16 elongated members. A light emitting apparatus 32 is attached to the mount. The light emitting apparatus 32 includes a loop 34 that has light emitters 36 therein. The light emitters 36 may be electrically powered lights, such as light emitting diodes, or may include conventional glow sticks removably positioned within the loop. The loop 34 bounds an opening 38 extending through the loop 34. The loop 34 is a closed loop having a pair of ends 40 attached to the mount 30 and which may be removed for positioning light emitters 36 within the loop 34. The loop 34 lies in a same plane as the first 14 and second 16 elongated members.

Additionally, the first 14 and second 16 elongated members and the bracing members 18 may each be comprised of a translucent material as well. Light emitters 36, such as light emitting diodes or glow stick, may be positioned within these portions of the frame 12. The frame 12 may be disassembled to access and interior of the first 14 and second 16 elongated members and the bracing members 18 to allow insertion of the light emitters 36. Alternatively, only some of these elements may be translucent as needed to form an effective target as will be shown below.

A panel 42, comprised of a translucent material, is positioned on an upper side of the frame 12 and covers the frame 12. In particular, the panel 42 extends over each of the bracing members 18 and the first 14 and second 16 elongated members. The panel 42 has a top side 44 and a bottom side 46. The panel 42 has an aperture 48 therein extending into the top side 44 and outwardly of the bottom side 46. The aperture 48 is aligned with the opening 38 and has a diameter that is equal to or less than a diameter of the opening 38. The aperture 48 has a circular shape.

In use, the assembly 10 is used in a conventional manner to play games where players attempt to throw articles, such as bean bags 56 and the like, through the aperture 48 to gain points. Such games are ubiquitous but cannot be played at night as the aperture 48 and playfield cannot be seen. When the ambient light is insufficient to see the aperture 48, the light emitting apparatus 32 is used to direct a person in aiming. The translucent nature of the panel 42 allows the players to see the loop 34 which forms an outline for the aperture 48.

Figure 5:
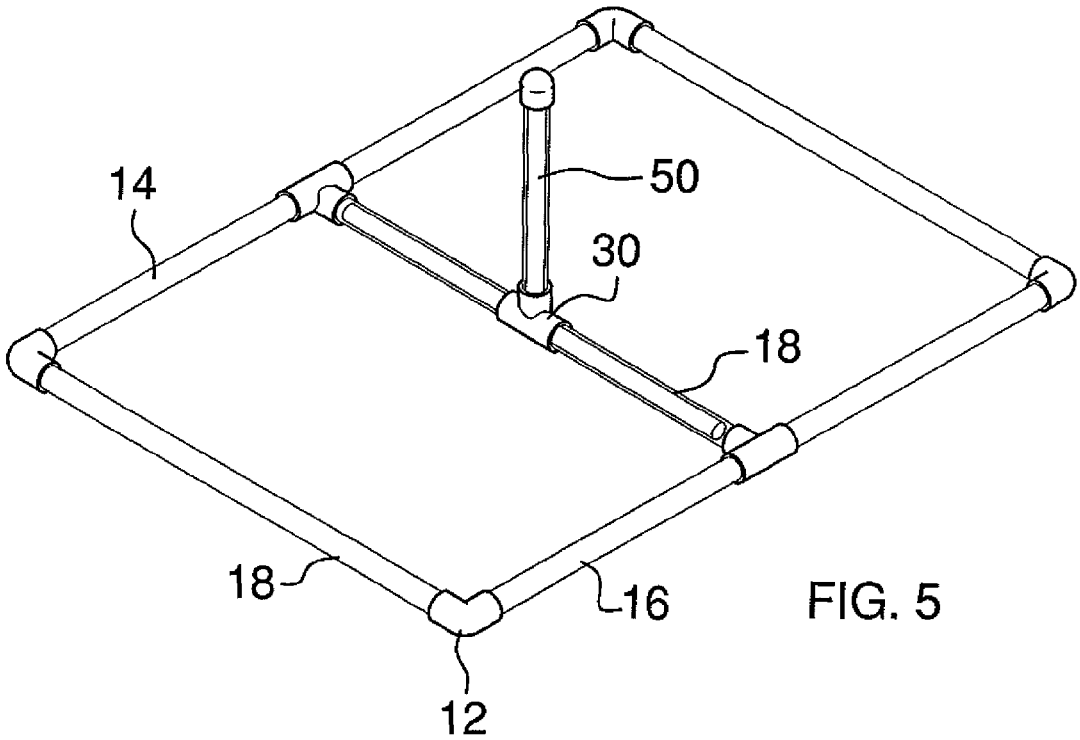
FIG. 5 is a top perspective view of an embodiment of the disclosure.

As shown in FIG. 5, another embodiment is shown wherein a post 50 is attached to the mounting 30 and is extended straight up from the frame 12. The post 50 comprises a translucent light emitting apparatus, having a same light emitting means as discussed above, and can be used with rings 52 and horseshoe shaped throwing articles 54. As can be readily understood from the Figures, the frame 12 can be readily converted from one game using the cover 42 to another game utilizing the post 50. Each of the rings and horseshoe shaped throwing articles 54 may also be translucent and contain one or more light emitters 36. The games played with the embodiment shown in FIG. 5 may include conventional scoring as is often found in ring toss and horseshoe type games.

Figure 6:
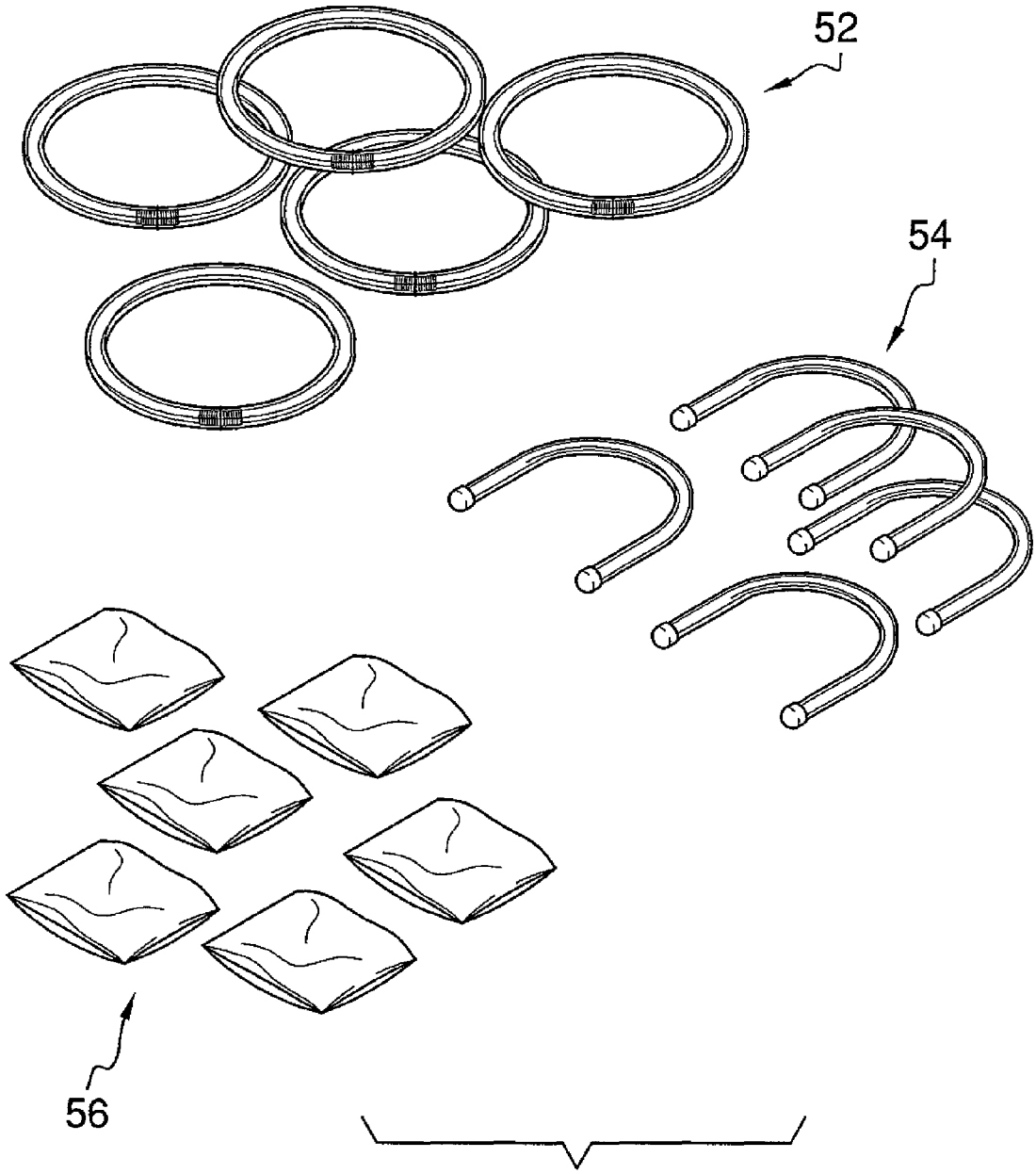
FIG. 6 is a top perspective view of a plurality of throwing articles of an embodiment of the disclosure.
Figure 7:
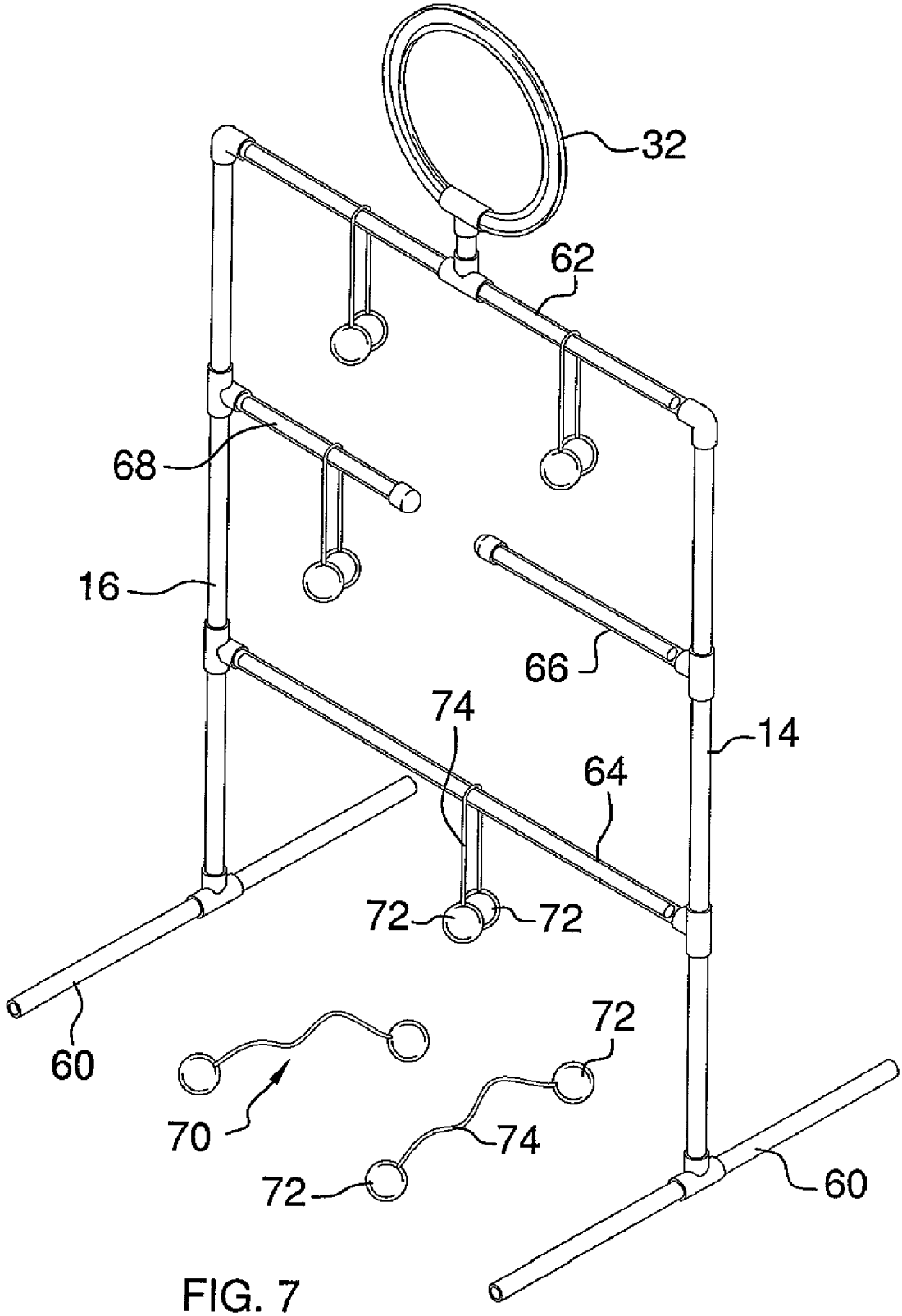
FIG. 7 is a top perspective view of an embodiment of the disclosure.

Another embodiment is shown in FIG. 6 and includes the first 14 and second 16 elongated members positioned in a vertical orientation each having supports 60 attached to the first end ends. The supports 60 are orthogonal with respect to the first 14 and second 16 elongated members and extend forward and rearward of the first ends 20 to support the first 14 and second 16 elongated members in the vertical orientation. The bracing members 18 of this embodiment define an upper brace 62 extending between the second ends and a lower brace 64 positioned nearer to the first ends 20 than the second ends 22. The upper 62 and lower 64 braces are each translucent and include light emitters 36 therein. This embodiment may also include a first rod 66 and a second rod 68. The first rod 66 is attached to the first elongated member 14 and the second rod 68 is attached to the second elongated member 16. The first 66 and second 68 rods are extend toward each other and are equidistant from the upper brace. An open space is defined between the first 66 and 68 rods as the first 66 and second 68 rods each have a length being less than one half of a length of the braces 18. Each of the first 66 and second 68 rods are translucent and include an internal light emitter 36. The post 50 of the embodiment in FIG. 5 may have a size to be transposed with the first 66 and second rods 68. The mount 30 is attached to the upper brace 62 so that it can support the loop 34 over the upper brace 62.

Once the frame 12, as shown in FIG. 6, is constructed, the players utilize bolas 70 consisting of a pair of balls 72 and a tether 74 extending between and attached to the balls 72. The balls 72 may be comprises of an elastomeric material. The balls 72 may also be translucent and have a light emitting apparatus therein to clearly sec the bolas 72 when they are thrown. For this embodiment, scoring for example may be accomplished by hooking the tethers on the loop 34, upper brace 62, lower brace 64 and the first 66 and second 64 rods with scoring being 5 points, 2 points, 1 point, and 3 points, respectively. The first player or teams of players who reach 21 points wins but points are only scored for the bolas 70 that remain on the frame after each team has thrown three bolas 70.

As can be seen from the above, the assembly 10 may comprise a kit including a plurality of frame elements and throwing elements which allows a person to select from a plurality of games and construct the frame to suit the game to be played. The light emitters 36 allow each of the games to be played at night.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure.

We claim:

1. A game station assembly for receiving tossed articles, said assembly including:

a frame including a first elongated member and a second elongated member being spaced from each other and being orientated parallel with respect to each other, a plurality of bracing members being attached to and extending between said first and second elongated members, each of said first and second elongated members having a first end and a second end;

a mount being attached to one of said bracing members;

a light emitting apparatus being attached to said mount;

a panel being positioned on an upper side of said frame and covering said frame, said panel having a top side and a bottom side, said panel having an aperture therein extending into said top side and outwardly of said bottom side, said aperture being positioned adjacent to said light emitter, said panel being comprised of a translucent material; and wherein said light emitter is visible through said panel to direct a person where to aim when attempting to throw articles through said aperture.

2. The assembly according to claim 1, further including a first leg being attached to and extending downwardly from said first end of said first elongated member and a second leg being attached to and extending downwardly from said first end of said second elongated member, said legs supporting said frame in an angular relationship with respect to a ground surface and being angled downwardly from said first ends to said second ends of said elongated members.

3. The assembly according to claim 2, further including a brace being attached to and extending between distal ends of legs with respect to said first ends.

4. The assembly according to claim 1, wherein said mount is positioned nearer said first ends than said second ends and being positioned approximately an equal distance from said first and second elongated members.

5. The assembly according to claim 1, wherein said light emitting apparatus includes a loop having light emitters therein, said loop bounding an opening through said loop, said aperture being aligned with said opening.

6. The assembly according to claim 5, said aperture having a diameter equal to or less than a diameter of said opening.

7. The assembly according to claim 6, wherein said aperture has a circular shape.

8. The assembly according to claim 1, wherein said first and second elongated members are translucent, said bracing members being translucent, a plurality of light emitters being mounted within said frame.

9. A game station assembly for receiving tossed articles, said assembly including:

a frame including a first elongated member and a second elongated member being spaced from each other and being orientated parallel with respect to each other, a plurality of bracing members being attached to and extending between said first and second elongated members, each of said first and second elongated members having a first end and a second end, a first leg being attached to and extending downwardly from said first end of said first elongated member and a second leg being attached to and extending downwardly from said first end of said second elongated member, said legs supporting said frame in an angular relationship with respect to a ground surface and being angled downwardly from said first ends to said second ends of said elongated members, a brace being attached to and extending between distal ends of legs with respect to said first ends;

a mount being attached to one of said bracing members, said mount being positioned nearer said first ends than said second ends and being positioned approximately an equal distance from said first and second elongated members;

a light emitting apparatus being attached to said mount, said light emitting apparatus including a loop having at least one light emitter therein, said loop bounding an opening through said loop;

a panel being positioned on an upper side of said frame and covering said frame, said panel having a top side and a bottom side, said panel having an aperture therein extending into said top side and outwardly of said bottom side, said aperture being aligned with said opening, said panel being comprised of a translucent material, said aperture having a diameter equal to or less than a diameter of said opening, said aperture having a circular shape; and wherein said light emitter is visible through said panel to direct a person where to aim when attempting to throw articles through said aperture.

10. The assembly according to claim 9, wherein said first and second elongated members are translucent, said bracing members being translucent, a plurality of light emitters being mounted within said frame.

11. A game kit assembly including:

a frame including a first elongated member and a second elongated, each of said first and second elongated members having a first end and a second end;

a plurality of bracing members being attachable to and extendable to said first and second elongated members such that said bracing members are perpendicularly orientated to said first and second elongated members, each of said bracing members being translucent;

a first leg and a second leg, said first leg being attachable to said first end of said first elongated member and said second leg being attachable to said first end of said second elongated member such that said frame is supported in an angular relationship with respect to a ground surface and being angled downwardly from said first ends to said second ends of said elongated members;

a mount being attachable to one of said bracing members;

a light emitting apparatus being attached to said mount, said light emitting apparatus including a loop having at least one light emitter therein, said loop bounding an opening through said loop;

a pair of posts, each of said posts having a length being equal to less than one half a length of said braces, each of said posts being attachable to said first and second elongated members or one of said braces, each of said posts being translucent;

a pair of supports, each of said supports being removably attachable to one of said first and second elongated members to support said first and second elongated members in a vertical orientation extending upwardly from the ground surface;

a panel being positionable on an upper side of said frame and covering said frame when said frame is in said angular relationship to the ground surface, said panel having a top side and a bottom side, said panel having an aperture therein extending into said top side and outwardly of said bottom side, said aperture being alignable with said opening, said panel being comprised of a translucent material, said light emitter is visible through said panel to direct a person where to aim when attempting to throw articles through said aperture;

a plurality of light emitters being mounted within said frame;

a plurality of rings for throwing at one of said posts;

a plurality of horseshoe shaped members for throwing at said posts;

a plurality of bags for throwing through said aperture; and a plurality of bolas for throwing at said light emitting apparatus, said braces and said posts.

* * * * *